US008814018B1

(12) United States Patent
Mozes

(10) Patent No.: US 8,814,018 B1
(45) Date of Patent: Aug. 26, 2014

(54) QUICK DRAW BOW HOLDER

(71) Applicant: Raymond P. Mozes, Greenville, PA (US)

(72) Inventor: Raymond P. Mozes, Greenville, PA (US)

( * ) Notice: Subject to any disclaimer, the term of this patent is extended or adjusted under 35 U.S.C. 154(b) by 22 days.

(21) Appl. No.: 13/734,706

(22) Filed: Jan. 4, 2013

(51) Int. Cl.
*A45F 5/00* (2006.01)

(52) U.S. Cl.
USPC ..... 224/625; 224/242

(58) Field of Classification Search
CPC A45F 5/00; A45F 2003/007; A45F 2003/025
USPC ..... 224/625, 242
See application file for complete search history.

(56) References Cited

U.S. PATENT DOCUMENTS

| | | | | | |
|---|---|---|---|---|---|
| 2,446,197 | A * | 8/1948 | Sloan | 224/150 |
| 2,647,667 | A * | 8/1953 | Brown et al. | 224/149 |
| 3,869,074 | A * | 3/1975 | Roach | 224/149 |
| 4,911,347 | A * | 3/1990 | Wilhite | 224/257 |
| 4,964,553 | A * | 10/1990 | Glynn | 224/149 |
| 5,431,317 | A * | 7/1995 | Kliot | 224/153 |
| 5,624,065 | A * | 4/1997 | Steffe | 224/625 |
| 5,687,896 | A * | 11/1997 | Clift | 224/587 |
| 5,730,341 | A * | 3/1998 | Hester, Jr. | 224/257 |
| 5,927,574 | A * | 7/1999 | Ruesink | 224/149 |
| 6,336,576 | B1 * | 1/2002 | Easter | 224/153 |
| 6,409,060 | B2 * | 6/2002 | Donine | 224/160 |
| 6,547,110 | B2 * | 4/2003 | O'Hare | 224/155 |
| 7,770,768 | B1 * | 8/2010 | Primos | 224/609 |
| 8,047,413 | B2 * | 11/2011 | Arajakis | 224/577 |
| 2006/0102674 | A1 * | 5/2006 | Godshaw et al. | 224/625 |
| 2013/0126568 | A1 * | 5/2013 | Arajakis | 224/257 |

* cited by examiner

*Primary Examiner* — Brian D Nash
(74) *Attorney, Agent, or Firm* — Richard K Thomson

(57) ABSTRACT

A support sling is provided having a plastic body portion, which may optionally be covered with fabric, and two orthogonally positioned straps. The body portion has an adjustably sized cup for receiving the cam or point of a compound or recurved bow, respectively, the size of the cup being adjustable to accommodate differing sized cams. Slots in the vertically extending web portion of the body receive the straps. At least some of the slots have angled extensions which permit the straps to being reoriented relative to the body portion as the hunter shifts position or moves the bow holder to an alternate location.

11 Claims, 6 Drawing Sheets

QUICK DRAW BOW HOLDER

The present invention is a continuation of U.S. patent Ser. No. 11/129,544 filed May 13, 2005.

BACKGROUND AND SUMMARY OF THE INVENTION

The present invention is directed to the field of hunting accessories. More particularly, the present invention is directed to a quick draw bow holding sling which enables the weapon to be brought to the ready position with a minimal amount of movement.

Bow hunting is becoming increasingly popular, perhaps because bow hunting is more man vs. nature, as opposed to technology vs. nature. In any event, when stalking certain particularly skittish game, bear for example, it is of critical importance that movement be minimized as any motion and/or noise will set the quarry a-running. By the same token, patience is essential for the bow hunter since s/he must await the arrival of the target. Holding a bow, compound or recurved, at the ready position for extended periods of time, is physically taxing. Therefore, it is necessary to provide a bow support which keeps the bow as near the ready position as possible to minimize the movement needed to launch the arrow at its target.

The quick draw bow holder of the present invention is versatile, being capable of attachment to the hunter's calf, thigh or waist via a belt, depending on the hunter's posture. The versatility of the present invention enables the user to readily shift position without having to remove the bow holder by simply repositioning the bow supporting cup on its support straps.

The quick draw bow holder of the present invention comprises a body portion having a generally vertically extending web portion with a first plurality of slots extending in a first direction, a second plurality of slots extending in a generally orthogonal direction, a cup extending in a generally horizontal direction for receiving one end of and supporting the bulk of the weight of a bow; first strap means oriented in a first direction and extending through at least two of the first plurality of slots; second strap means oriented in a second direction which is generally perpendicular to the first direction and extending through at least two of the second plurality of slots; whereby the first and second strap means enables the bow holder to be attached to a portion of a hunter's anatomy allowing the bow to be quickly brought to a ready position with minimal movement. The first and second strap means are preferably elastic bands which stretch, facilitating the hunter's movement between various positions and minimizing interruption of circulation.

At least some of the first and second pluralities of slots have angled extensions emanating from each end of a generally vertical slot portion, the angled extensions facilitating reorientation of the bow holder while still attached to the hunter. The body portion of the bow holder is made of a durable plastic such as a TPE blend. The body portion has inner and outer surface portions and at least a majority of the inner surface portion is coated with a fabric to reduce noise. More preferably, the inner and outer surfaces are coated with a fabric which may be a solid color or imprinted with a camouflage print.

The size of the cup can be adjusted to accommodate different sized cams on the bow ends. This can be done by moving the barbed ends between adjacent recesses in the lower end of the web or simply tightening the dimension of the cup by pulling the end(s) of the peripheral wall of the cup so that an adjacent barb engages the edges of the slot. The bottom portion of the cup has a plurality of slip-resisting apertures.

Various other features, advantages and characteristics of the present invention will become apparent to one of ordinary skill in the art after a reading of the following specification.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF PREFERRED EMBODIMENT(S)

Figure 1:
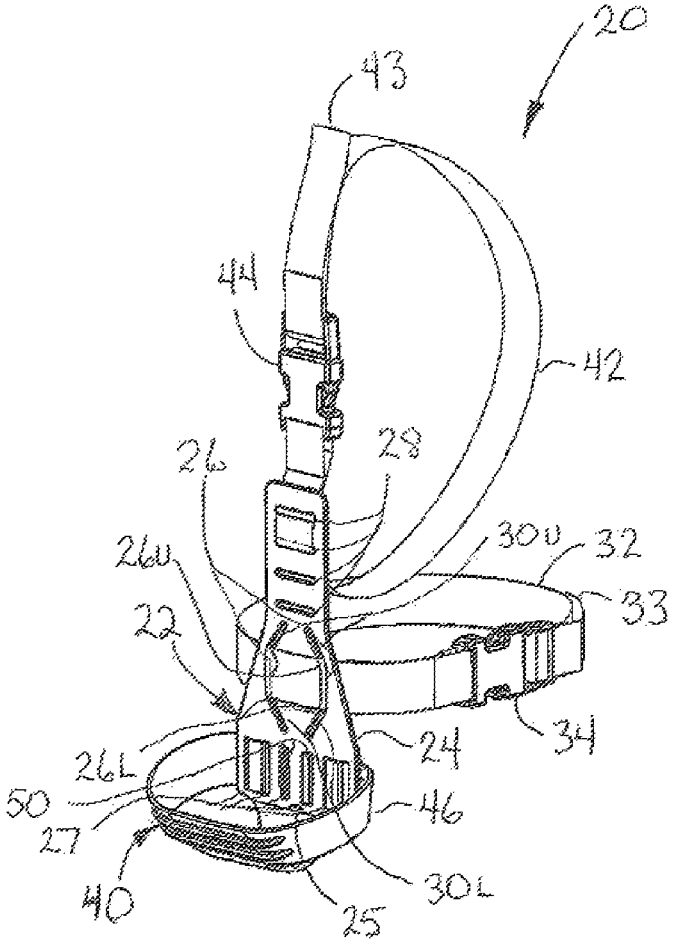
FIG. 1 is a perspective front view of a first embodiment of the quick draw bow holder of the present invention.
Figure 2:
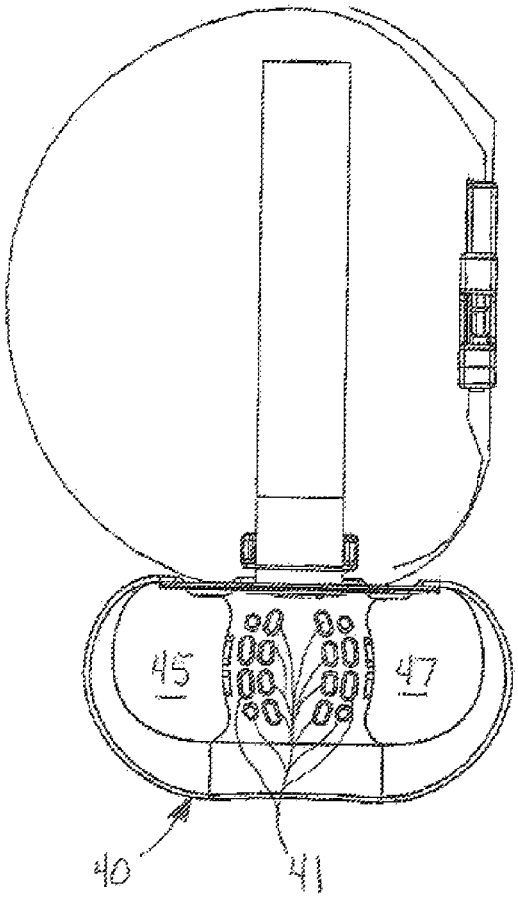
FIG. 2 is a top view of the first embodiment.
Figure 3:
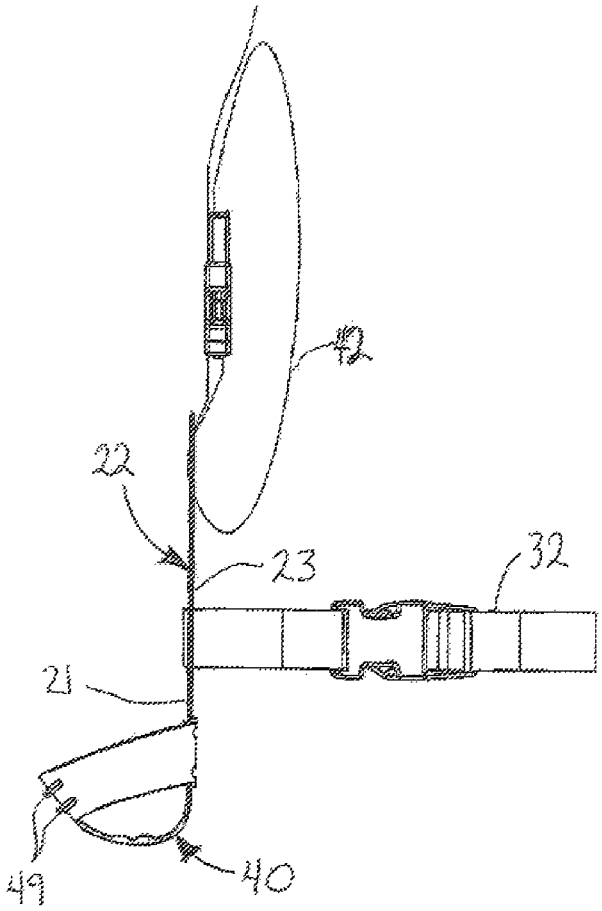
FIG. 3 is a side view of the first embodiment.

A first embodiment of the quick draw bow holder of the present invention is shown in FIGS. 1-3 generally at 20. Bow holder 20 includes a body portion 22, first strap means 32 oriented in a first direction and a second strap means 42 oriented in a second generally orthogonal direction. Body portion 22 includes generally vertically extending web portion 24 with a first plurality of slots 26 extending in a first direction and a second plurality of slots 28 extending in a second generally orthogonal direction.

The first strap means 32 is threaded through at least two of the first plurality of slots 26 while the second strap means 42 is threaded through at least two of the second plurality of slots 28. First and second strap means 32, 42 are preferably elastic (stretchable) so as not to impede circulation. Further, the ends 33, 43 are attached to buckles 34, 44, respectively, so that the length of strap means 32, 42 can be adjusted to accommodate different users and attachment configurations.

Figure 4:
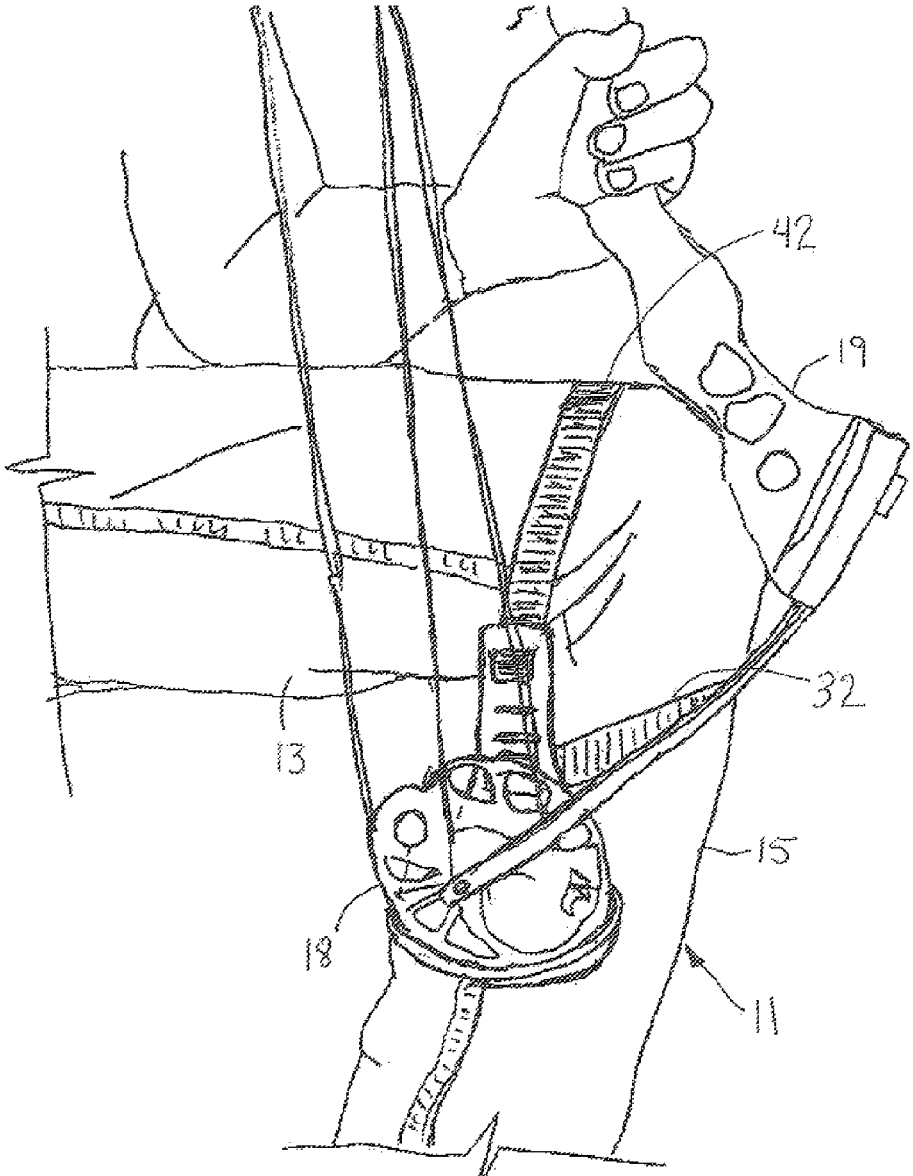
FIG. 4 is schematic front view depicting a first method of using the quick draw bow holder.
Figure 5:
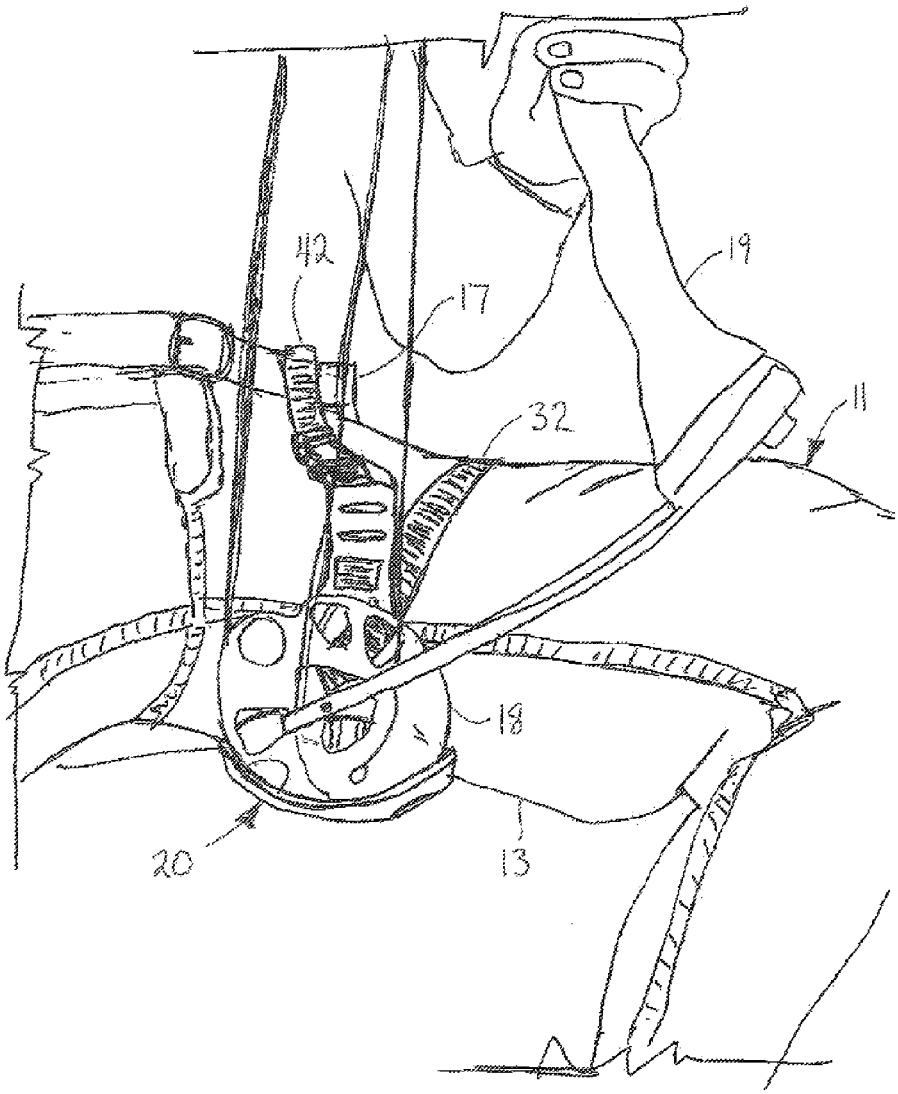
FIG. 5 is a schematic front view depicting a second method of use.
Figure 6:
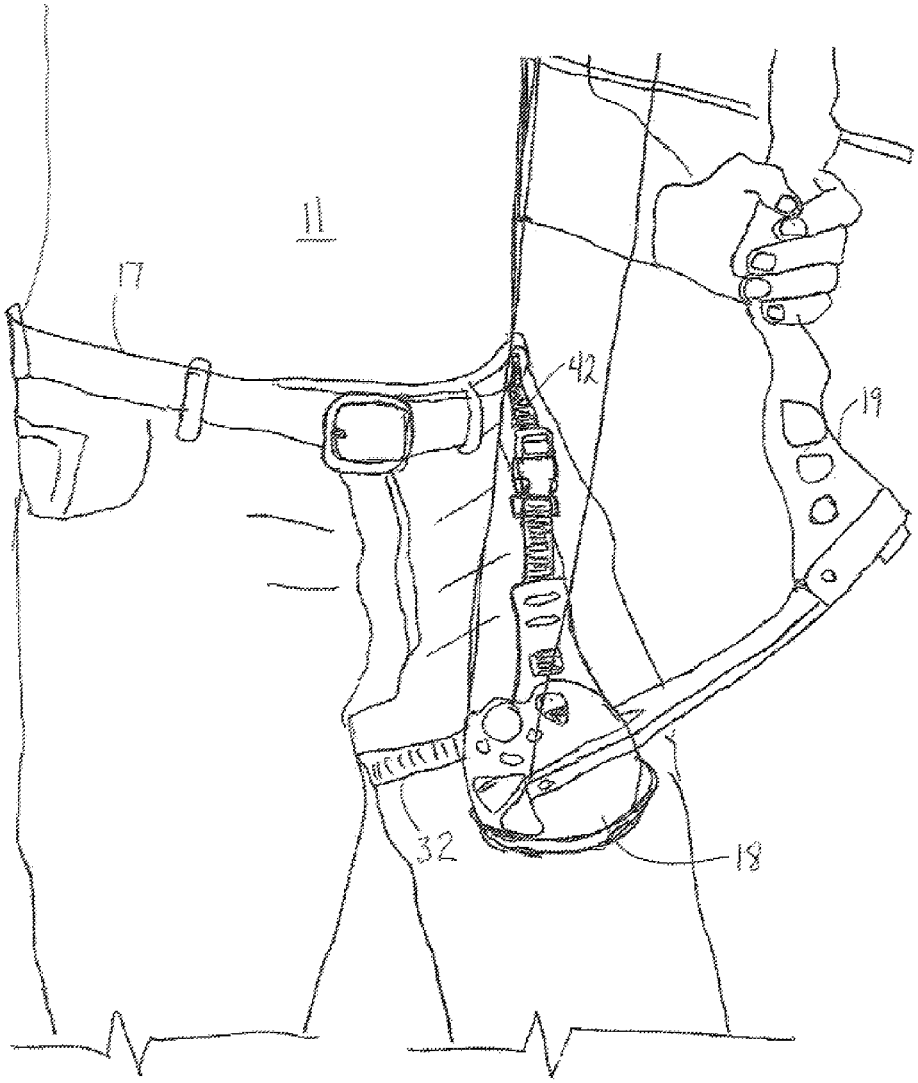
FIG. 6 is a schematic front view depicting a third method of use.

At least some of the first and second pluralities of slots 26, 28 have angled extensions 30$_U$, 30$_L$ extending from slot end portions 26$_U$ and 26$_L$, respectively. Angled extensions 30$_U$, 30$_L$ permit reorientation of strap 32 relative to web portion 24 facilitating realignment of bow holder 20 relative to hunter 11 (FIGS. 4-6). Accordingly, bow holder 20 can be secured via strap means 42 to the hunter's thigh 13 and strap means 32 to the hunter's calf 15 as seen in FIG. 4. Alternatively, strap means 32 can be secured to the hunter's thigh 13 and strap means 42 to the hunter's belt 17 in a sitting position (FIG. 5) or in a standing position (as shown in FIG. 6). The angled extensions 30$_U$, 30$_L$ and the elasticity of strap means 32, 42 contribute to the ease with which the hunter can change positions.

Body portion 22 further includes cup 40 which receives, for example, the cam 18 of a compound bow 19 (FIG. 4). Lower peripheral portion 25 of web portion 24 has a plurality of recesses 27 formed therein. Peripheral wall 46 of cup 40 has a pair of ends with barbs 50 formed thereon. The size of cup 40 can be adjusted (reduced) by either of two ways: 1) by pulling on the ends of peripheral wall 46 such that different barbs 50 engage in recesses 27 or 2) by moving barbs 50 from one set of recesses 27 to another more closely spaced set of recesses. Cup 40 has a plurality of holes 41 (FIG. 2) formed therein to provide slip resistance for the end of a recurve or long bow. Further, openings 45, 47 provide additional space for oversized cams 18. Reinforcing ribs 49 provide additional strength to peripheral wall 46.

The body portion 22 is preferably made from a durable plastic material such as a TPE blend. Alternatively, body portion 22 could be made of leather, without departing from the spirit of the invention. The inner surface 21 and outer surface 23 (FIG. 3) are optionally covered with fabric to reduce sound when the bow 19 is inserted therein. When fabric is used, it can be either a solid drab color or, more preferably, a camouflage pattern to enable it to blend with the clothing most typically worn by hunters.

The quick draw bow holder 22 of the present invention is versatile, enabling the hunter to support her/his bow in a close to ready position and quickly, quietly, shoot an arrow when the opportunity presents itself.

Various changes, alternatives and modifications will become apparent to one of ordinary skill in the art following a reading of the foregoing specification. It is intended that any such changes, alternatives and modifications as fall within the scope of the appended claims be considered part of the present invention.

I claim:

1. A quick draw bow holder comprising a) a body portion having a generally vertically extending web portion with a first plurality of slots extending in a first direction, a second plurality of slots extending in a second direction generally orthogonal to said first direction, a cup extending in a generally horizontal direction for receiving one end of and supporting the bulk of the weight of a bow, wherein a lateral extent of said cup can be adjusted in size to accommodate different sized cams on the bow ends, a side wall of said cup having barb means formed thereon;

b) first strap means oriented in a first direction and extending through at least two of said first plurality of slots;

c) second strap means oriented in a second direction which is generally perpendicular to said first direction and extending through at least two of said second plurality of slots;

d) angled extensions emanating outwardly away from each end of at least some of said first and second pluralities of slots to facilitate reorientation of said bow holder from a first position attached to a first portion of a hunter's anatomy to a second position in which said bow holder is attached to a second portion of a hunter's anatomy by slidingly receiving reoriented strap means;

whereby said first and second strap means enables said bow holder to be attached to a portion of a hunter's anatomy allowing the bow to be quickly brought to a ready position with minimal movement.

2. The quick draw bow holder of claim 1 further wherein said first and second strap means comprise elastic bands which stretch facilitating the hunter's movement between various positions.

3. The quick draw bow holder of claim 1 where said body portion is made of a durable plastic.

4. The quick draw bow holder of claim 3 wherein said body portion has inner and outer surface portions and at least a majority of said inner surface portion is coated with a fabric.

5. The quick draw bow holder of claim 4 wherein all of said inner surface portion is coated with said fabric.

6. The quick draw bow holder of claim 5 wherein all of said inner and outer surface portions are coated with a camouflaging fabric.

7. The quick draw bow holder of claim 1 further comprising a plurality of recesses formed in said web portion into which said barb means may be selectively snapped.

8. The quick draw bow holder of claim 1 further comprising a bottom portion of said cup, said bottom portion having a plurality of slip-resisting apertures.

9. A quick draw bow holder comprising a) a body portion having a generally vertically extending web portion with a first plurality of attachment slots extending in a first direction, a second plurality of attachment slots extending in a second direction generally orthogonal to said first direction, and a third plurality of slots formed along a lower peripheral portion;

b) a cup integrally formed with said web portion and extending in a generally horizontal direction for receiving one end of and supporting the bulk of the weight of a bow, said cup including a peripheral wall portion with distinct ends, said distinct ends having barb means formed thereon, each of said barb means snapping into one of said third plurality of slots;

whereby a size of said cup may be readily adjusted to accommodate end portions of varying sized bows.

10. The quick draw bow holder of claim 9 further comprising a) first strap means oriented in a first direction and extending through at least two of said first plurality of slots;

b) second strap means oriented in a second direction which is generally perpendicular to said first direction and extending through at least two of said second plurality of slots.

11. The quick draw bow holder of claim 10 wherein said first and second strap means comprise elastic bands with adjustable buckles.

* * * * *